US009834953B2

(12) United States Patent
Ways

(10) Patent No.: US 9,834,953 B2
(45) Date of Patent: Dec. 5, 2017

(54) CUBULAR UTILITY BARRIER ENCLOSURE (C.U.B.E.)

(71) Applicant: David Edward Ways, Bradenton, FL (US)

(72) Inventor: David Edward Ways, Bradenton, FL (US)

( * ) Notice: Subject to any disclaimer, the term of this patent is extended or adjusted under 35 U.S.C. 154(b) by 81 days.

(21) Appl. No.: 15/001,231

(22) Filed: Jan. 19, 2016

(65) Prior Publication Data

US 2016/0208513 A1 Jul. 21, 2016

Related U.S. Application Data

(60) Provisional application No. 62/104,868, filed on Jan. 19, 2015.

(51) Int. Cl.

| | |
|---|---|
| ***E04H 15/40*** | (2006.01) |
| ***E04H 15/42*** | (2006.01) |
| ***E04H 15/44*** | (2006.01) |
| ***E04H 15/48*** | (2006.01) |
| *E04H 15/32* | (2006.01) |

(52) U.S. Cl.

CPC ..... *E04H 15/425* (2013.01); *E04H 15/40* (2013.01); *E04H 15/44* (2013.01); *E04H 15/48* (2013.01); *E04H 2015/326* (2013.01)

(58) Field of Classification Search

CPC ..... E04H 15/40; E04H 15/58; E04H 15/405; E04H 15/425; E04H 15/44; E04H 2015/326; E04H 15/60

USPC ..... 135/125–126, 128, 156, 905, 143–144, 135/147, 119

See application file for complete search history.

(56) References Cited

U.S. PATENT DOCUMENTS

| | | | | |
|---|---|---|---|---|
| 3,028,871 A * | 4/1962 | Clift, Jr. | E04H 15/46 | 135/130 |
| 4,590,956 A * | 5/1986 | Griesenbeck | E04H 15/40 | 135/116 |
| 4,723,371 A * | 2/1988 | Williams | A01M 31/025 | 135/127 |
| 4,819,680 A * | 4/1989 | Beavers | E04H 15/48 | 135/119 |
| 5,137,044 A * | 8/1992 | Brady | E04H 15/56 | 135/126 |
| 6,517,444 B1 * | 2/2003 | Yoon | A63B 71/022 | 273/400 |

(Continued)

*Primary Examiner* — Winnie Yip

(57) ABSTRACT

A scalable, light-weight, portable, self-supporting and adjustable, multi-purpose, cubular utility barrier enclosure (C.U.B.E.) structural system, made of a membrane that defines a space and resiliently flexible poles, that maintain a stable shape as the membrane is pushed out by the poles connected together in flexed pole loops contained within the space, that are caused to bow in a flexed condition and are biased in place by the membrane when the poles are positioned in a freestanding manner, with adjustable section lengths that slip fit connect together to form various flexed pole loop configurations in proportion with the membrane to be biased in place, the membrane is constituted by pliable mesh that is substantially impermeable to insects, comprised of durable, high-tenacity synthetic fiber, resistant to puncture, prolong exposure to the sun, wind, and weather elements, substantially waterproof, thermally insulated, fire resistant, and configured in various shapes and sizes.

12 Claims, 6 Drawing Sheets

(56) References Cited

U.S. PATENT DOCUMENTS

| | | | | |
|---|---|---|---|---|
| 6,672,323 | B2 * | 1/2004 | Gupta | E04H 15/40 135/126 |
| 6,851,439 | B2 * | 2/2005 | Zheng | A63B 9/00 135/117 |
| 7,174,584 | B2 * | 2/2007 | Danaher | E04H 15/40 135/126 |
| 7,201,177 | B2 * | 4/2007 | Anticoli | E04H 15/40 135/124 |
| 7,921,863 | B2 * | 4/2011 | Ways | E04H 15/34 135/125 |
| 2008/0072947 | A1 * | 3/2008 | Lanham | E04H 15/40 135/126 |

* cited by examiner

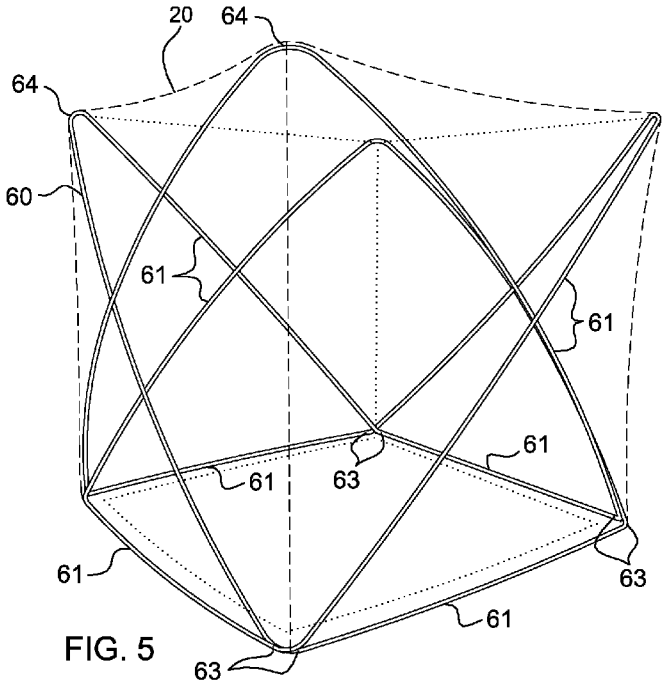
FIG. 5
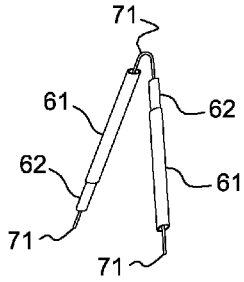
FIG. 10
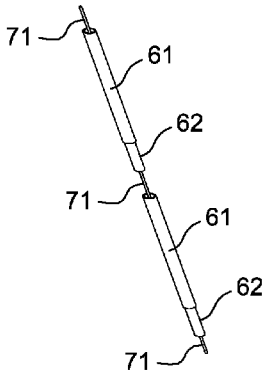
FIG. 9
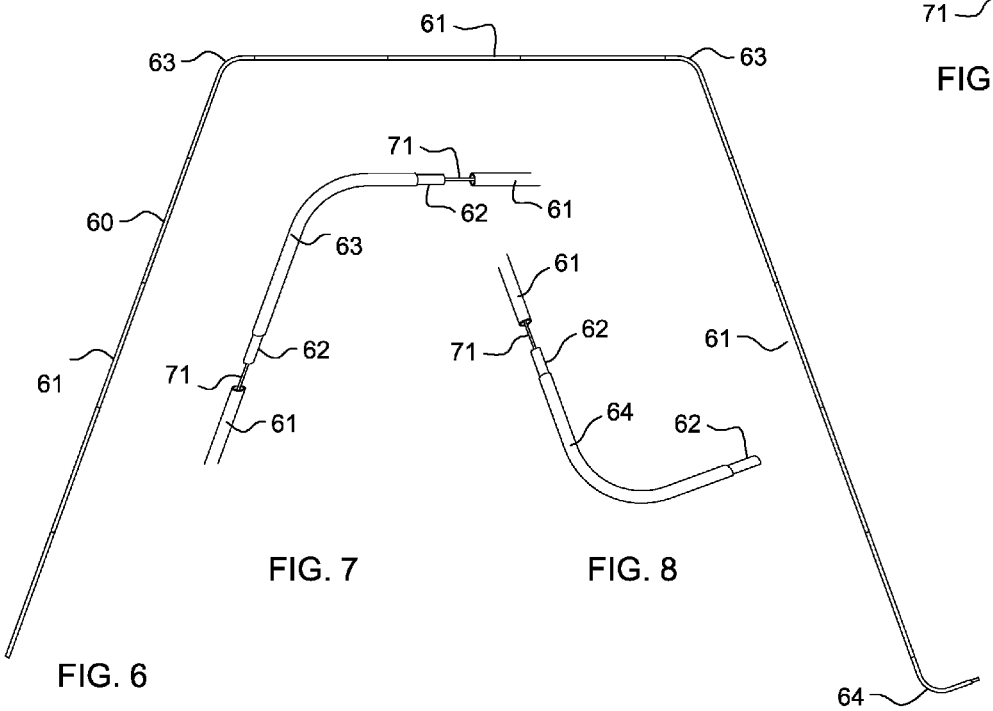
FIG. 7
FIG. 8
FIG. 6

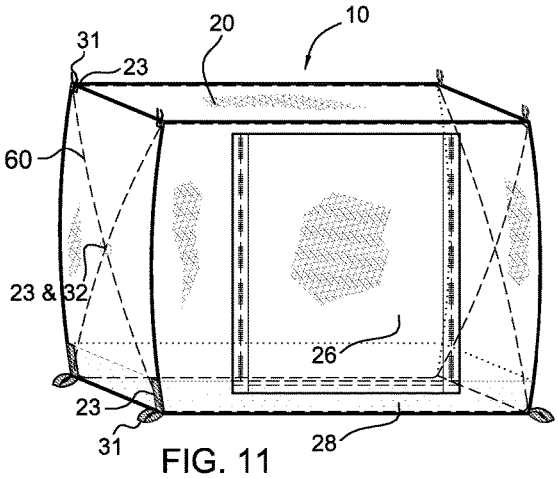
FIG. 11
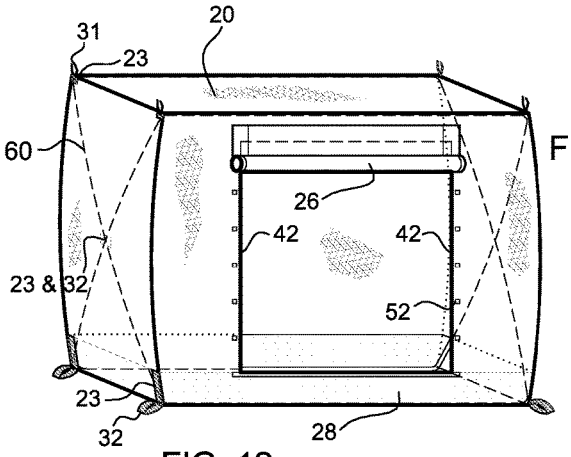
FIG. 12
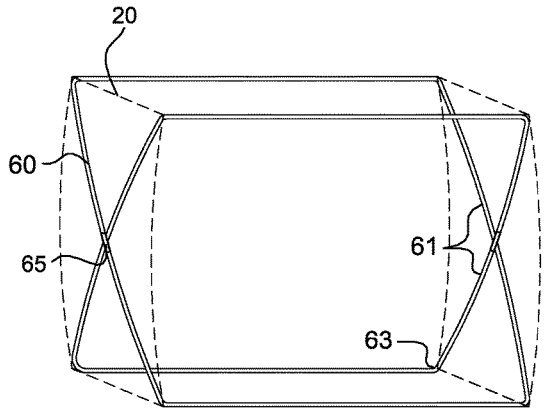
FIG. 13
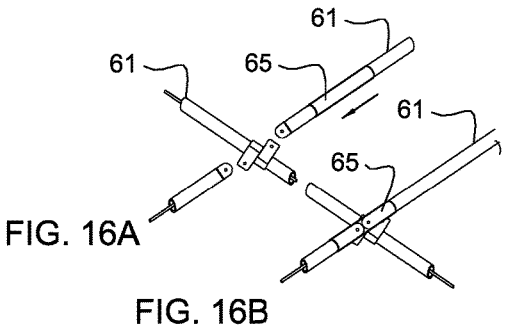
FIG. 16A
FIG. 16B
FIG. 16
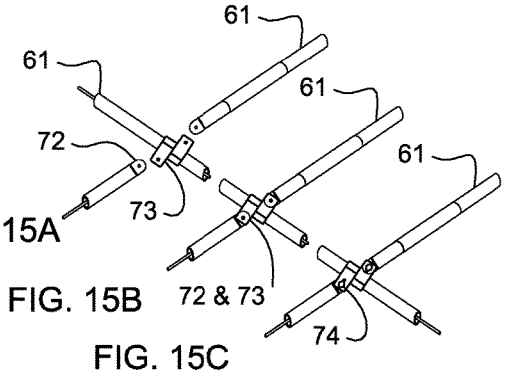
FIG. 15A
FIG. 15B
FIG. 15C
FIG. 15
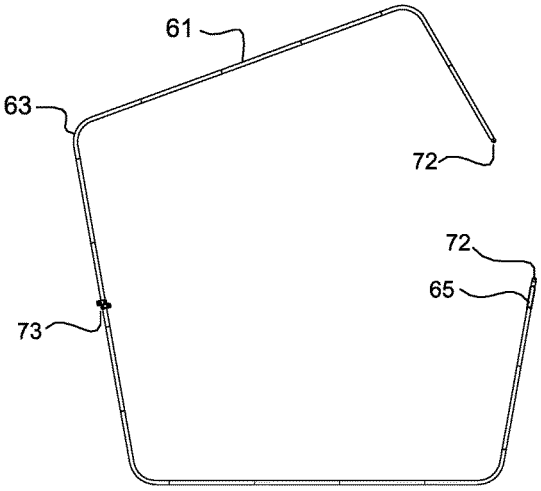
FIG. 14

CUBULAR UTILITY BARRIER ENCLOSURE (C.U.B.E.)

This is a Utility U.S. Patent application filed under 35 USC §111(a).

STATEMENT REGARDING FEDERALLY SPONSORED RESEARCH OR DEVELOPMENT

Not applicable.

REFERENCE TO APPENDIX

The following appendices form part of this application:

Appendix 1: Cubular Utility Barrier Enclosure (C.U.B.E.) drawings (6 pages)

1. TECHNICAL FIELD

The present invention relates to a Cubular Utility Barrier Enclosure (C.U.B.E.)

The invention further relates to a scalable, light-weight, portable, self-supporting and adjustable, multi-purpose, cubular utility barrier enclosure (C.U.B.E.), for any use.

2. BACKGROUND OF THE INVENTION

This present invention improves upon several aspects of utility enclosures that provide a barrier for insects, weather and other environment conditions or any application for utility barrier enclosures, including their framework or supporting mechanism.

Typical portable enclosures of the art are disclosed in U.S. Pat. Nos. 4,236,543, 6,672,323, and 7,821,863. Although these tent structures utilize a flexible support system, they are different from the current invention, in that the flexible supports are either attached to the exterior peripheral portions, they are permanently affixed to the tent, or they are not freestanding and adjustable loop configurations.

The Moss patent ('543) is a portable tent, comprising a flexible covering held tense to provide the shape of the shelter by two resiliently flexible pole members held in a flexed condition by peripheral portions of said side walls, each said pole member having the end portions thereof held respectively by front and rear peripheral portions of the same side wall to hold the pole member in an inverted generally U-shape, tensing said side walls horizontally and the central portion thereof held by the upper peripheral portion of the other side wall to hold the pole member in a bowed shape.

The Gupta patent ('323) is a lightweight, self-erecting bednet structure having integral self-supporting resilient lower and upper loops which provide it with shape and support. Fabric is permanently affixed to the support loops. This bednet is a fixed size and shape, intended for use by a single occupant lying down as a barrier to insects; it is not ideal for use in any other configuration or application.

The Ways patent ('863) is a portable and lightweight, self-supporting, high-profile, net enclosure comprised of a fabric membrane that defines an interior rectangular space having opposing side walls and opposing end walls, a floor and ceiling; a fabric pouch; two resiliently flexible segmented poles having two angles each that separate three straight pole sections into one horizontal section and two vertical sections with domed end tips; durable fabric reinforcing patches in lower inside corners of said interior rectangular space; said net enclosure maintains a stable shape when said fabric membrane is pushed out by said poles that are contained within said interior rectangular space and caused to bend in a flexed condition by said fabric membrane that biases said poles in place when said poles domed end tips are positioned in a freestanding manner on said durable fabric reinforcing patches in opposing lower inside corners of said interior rectangular space, with said vertical pole sections crossing diagonally at said end walls, and said horizontal pole section of said poles positioned parallel to each other along top of said opposing side walls at said ceiling with said two angles of each said pole positioned in a freestanding manner in upper inside corners of said interior rectangular space. This bednet is a fixed size and shape, intended for use by a single occupant lying down as a barrier to insects; the poles do not form closed loops and are not adjustable; it is not ideal for any other configuration.

Citrus Greening (*Candidatus* Liberibacter *asiaticus*) is one of the most serious citrus plant diseases in the world. It is also known as Huanglongbing (HLB) or yellow dragon disease. Citrus greening is spread by a disease-infected insect, the Asian citrus psyllid (*Diaphorina citri* Kuwayama or ACP). Infected trees produce fruits that are green, misshapen and bitter, unsuitable as fresh fruit or for juice. Most infected trees die within a few years.

A key component to a management program for Huanglongbing (HLB), "citrus greening disease" is aggressive control of Asian citrus psyllid (ACP). *Tamarixia radiata* Waterston (Hymenoptera: Eulophidae), a species specific ectoparasitoid of the ACP was imported from Pakistan and permitted by the USDA Plant Protection and Quarantine (PPQ) Permitting Unit for field release in Texas. Mass production methods continue to be refined and enhanced by the USDA's Mission Laboratory.

These methods involve covering live mature citrus trees, infested with ACP, inside field cages and introducing *Tamarixia radiata* into these enclosures that contain an abundant food supply, enabling them to multiply over 2-3 generations and then be released into the surrounding environment. The field cage approach being used in Texas is a novel approach that yields 12K parasitoids per cage. An improved insectary field cage could help augment those numbers.

This invention improves upon the field cages that are used in the mass production methodology, by accommodating various tree sizes, enabling more light into the enclosures, requiring fewer and lighter structural components, being durable, self-supporting, scalable and containing all components in an attached pouch for ease of transport and deployment.

This invention improves upon recreational and vendor canopies being durable against high winds, having side walls that provide a barrier to insects and solar shading, self-supporting, scalable, and containing all components in an attached pouch for ease of transport.

There is an increasing need for improved humanitarian relief shelters that provide durable protection from insects, weather and extreme environment conditions, to increase the level of comfort for displaced people living in family tents for prolong duration.

At present, the available humanitarian shelters are typically one of the follow: a rigid hard shell box shape, dome shape, barrel-vault shape, rectangular shape with vertical walls and gable roof, or free-formed pieced together from available loose wood structural supports and covered with tarps or plastic.

Each of the above mentioned current forms of shelter have limitations that make them inadequate to address the growing demand worldwide for more durable humanitarian relief shelters that are modular, compact, and adaptable, designed with architectural considerations in mind for occupant health and welfare, and improve the human factor conditions, including sustained comfort for prolonged occupancy.

Ridged hard shell structures are heavy, difficult to maneuver and expensive to transport due to their static shape, making it impractical to reach remote areas.

Dome shape tents have bowed poles connected through sleeves on the exterior of the flexible membrane with the pole ends placed in outside corner sockets to maintain its shape.

The dome shape creates low confining headroom along the walls that prevent occupants from standing upright and are generally intended for temporary use while camping.

Dome shape tents are designed to stand alone, and not suitable for grouping several together under a single cover to make one larger combined shelter.

Dome tents require guy wires for additional strength against high winds that extend several feet beyond the perimeter of the tent and anchor to the ground, taking-up additional surface area around the tent.

Barrel-vault tents have lower head height along the walls that limit the floor area for standing room, with wall panels comprised of separate membranes draped loosely over the rigid structural frame made from heavy arched-shape poles.

Rectangular shaped structures with vertical walls and gable roof require heavy poles and guy wires for additional strength against high winds that extend several feet beyond the perimeter of the tent to anchor to the ground, taking-up additional surface area around the tent.

Free-formed enclosures pieced together from available loose wood and make-shift structural supports, covered with tarps or plastic is a desperate attempt to address this dire need.

There is a desperate need for compact and portable humanitarian shelters that address the human factors habitability requirements to provide comfort for prolong use, made from durable, light-weight materials at are adaptable to various environmental conditions, scalable, using standardized modular structural components to construct multi-purpose enclosures.

Citation or identification of any reference in Section 2, or in any other section of this application, shall not be considered an admission that such reference is available as prior art to the present invention.

3. SUMMARY OF THE INVENTION

A scalable, light-weight, portable, self-supporting and adjustable, multi-purpose, cubular utility barrier enclosure (C.U.B.E.), is provided.

The cubular utility barrier enclosure (C.U.B.E.), provides improvements over other utility enclosures by employing a membrane that defines a space and resiliently flexible segmented poles, that maintain a stable shape as the membrane is pushed out by the poles connected together in loop configurations contained within the space, that are caused to bend in a flexed condition and are biased in place by the membrane when the flexed pole loops are positioned in a freestanding manner, with adjustable section lengths that slip fit connect together to form various flexed pole loops in proportion with the membrane to be biased in place.

In one embodiment, the cubular utility barrier enclosure (C.U.B.E.) membrane is pushed out further on the inside using an optional additional straight pole, that is biased in place by the membrane when positioned vertically in a freestanding manner, that causes the pole loops to bend further in a flexed condition as they are biased in place by the membrane when the flexed pole loops are positioned in a freestanding manner, increasing the structural stability without the need for guy wires.

In one embodiment, the cubular utility barrier enclosure (C.U.B.E.) membrane is pushed out further on the inside using an optional additional straight pole, that is biased in place by the membrane when positioned vertically in a freestanding manner, that causes the pole loops to bend further in a flexed condition as they are biased in place by the membrane when the flexed pole loops are positioned in a freestanding manner, creating a means for a "chimney effect" to promote passive vertical air circulation though optional vents in the membrane on top.

In one embodiment, the cubular utility barrier enclosure (C.U.B.E.) membrane, is constituted by pliable mesh that is substantially impermeable to insects, comprised of durable, high-tenacity synthetic fiber, resistant to puncture, able to withstand prolong exposure to the sun, wind and weather elements.

In another embodiment, the cubular utility barrier enclosure (C.U.B.E.) membrane has properties including but not limited to solar shading, substantially waterproof, airtight, thermally insulated, fire resistant, and chemically treated.

In one embodiment, the cubular utility barrier enclosure (C.U.B.E.) utilizes more than one membrane that are biased in place together by the flexed pole loops.

In one embodiment, the cubular utility barrier enclosure (C.U.B.E.) utilizes more than one membrane that are attached to the poles and secured tight horizontally or suspended vertically.

In another embodiment, the cubular utility barrier enclosure (C.U.B.E.) is deployed inside a larger cubular utility barrier enclosure (C.U.B.E.).

In another embodiment, the cubular utility barrier enclosure (C.U.B.E.) is deployed alongside another cubular utility barrier enclosure (C.U.B.E.).

In another embodiment, the cubular utility barrier enclosure (C.U.B.E.) is deployed alongside another cubular utility barrier enclosure (C.U.B.E.), and the two (C.U.B.E.) are covered together under an additional membrane shell to function as one.

In another embodiment, more than one cubular utility barrier enclosure (C.U.B.E.) is deployed alongside another cubular utility barrier enclosure (C.U.B.E.), and the group of (C.U.B.E.) are covered together under an additional membrane shell to function as one.

In one embodiment, the cubular utility barrier enclosure (C.U.B.E.) membrane is connected to the poles using fasteners at the upper and lower inside corners and at the side locations where the poles intersect.

In one embodiment, the cubular utility barrier enclosure (C.U.B.E.) is anchored to the ground or base in the lower inside and/or outside corners causing the poles to flex even further, increasing the structural stability without the need for guy wires.

In one embodiment, the cubular utility barrier enclosure (C.U.B.E.) poles are each formed by a plurality of pole segments that are inter-fitted and detachable, being tubular with an "insert" element extending from an end portion thereof and designed to fit within an end portion of the adjacent pole segment being interconnected by an elastic "shock-cord" running through the inside of each said pole.

In another embodiment, the cubular utility barrier enclosure (C.U.B.E.) poles are each formed by a plurality of pole segments that are inter-fitted and detachable, being tubular with an "insert" element extending from an end portion thereof and designed to fit within an end portion of the adjacent pole segment being inter-fitted and adjustable in a telescoping manner to adjust the pole segment lengths.

In another embodiment, the cubular utility barrier enclosure (C.U.B.E.) poles are each formed by a plurality of pole segments that are inter-fitted and detachable, being tubular with an "outsert" element extending from an end portion thereof and designed to fit over an end portion of the adjacent pole segment being inter-fitted and adjustable in a telescoping manner to adjust the pole segment lengths.

In another embodiment, the cubular utility barrier enclosure (C.U.B.E.) poles are each formed by a plurality of pole segments that are inter-fitted and detachable, being tubular with an "insert" and/or "outsert" element extending from an end portion thereof and designed to connect an end portion of the adjacent pole segment being inter-fitted with fixed pole segment lengths.

In another embodiment, the cubular utility barrier enclosure (C.U.B.E.) poles are each formed by a plurality of pole segments that are inter-fitted and detachable, being tubular with end tip elements extending from the two opposite end sections of a pole loop thereof and designed to connect to clamps at the mid-section of the other pole loop where the two pole loops cross combining the two pole loops into one flexed structural frame.

In another embodiment, the cubular utility barrier enclosure (C.U.B.E.) poles are each formed by a plurality of pole segments that are inter-fitted and detachable, being tubular with end tip elements extending from the two opposite end sections of a pole loop thereof and designed to connect to clamps at the mid-section of the other pole loop where the two pole loops cross, with an additional telescoping pole section that optionally enables connection of the two end sections of the same pole loop without using the clamps.

In one embodiment, the cubular utility barrier enclosure (C.U.B.E.) membrane defines a space that is fully enclosed or with side door access.

In another embodiment, the cubular utility barrier enclosure (C.U.B.E.) membrane defines a space that has an open floor with a skirt around the inside perimeter or with a removal floor membrane.

In another embodiment, the cubular utility barrier enclosure (C.U.B.E.) membrane defines a space that has closed floor with a waterproof membrane that extends partially up the side to create a waterproof tub.

In another embodiment, the cubular utility barrier enclosure (C.U.B.E.) membrane defines a space with a canopy biased in place by the top sections of the flexed pole loops or by the side walls of an additional membrane biased in place by the flexed pole loops.

In one embodiment, the cubular utility barrier enclosure (C.U.B.E.) has additional membranes configured with or without additional flexed pole loops to connect to another cubular utility barrier enclosure (C.U.B.E.).

In one embodiment, cubular utility barrier enclosure (C.U.B.E.) has additional membranes configured with or without additional flexed pole loops to stack on top of another cubular utility barrier enclosure (C.U.B.E.).

In one embodiment, cubular utility barrier enclosure (C.U.B.E.) has additional membranes configured with or without additional flexed pole loops to form planes inside the cubular utility barrier enclosure (C.U.B.E.) that define interior spaces, surfaces or other utility.

In one embodiment, the cubular utility barrier enclosure (C.U.B.E.) has an attached pouched comprised of generally pliable sheet material configured to be reversible to stow the cubular utility barrier enclosure (C.U.B.E.) with poles and anchors inside for transport.

In one embodiment, the cubular utility barrier enclosure (C.U.B.E.) provides improvements over current enclosures used as insectary field cages.

In one embodiment, the cubular utility barrier enclosure (C.U.B.E.) provides improvements over current enclosures used as insect field cages of various sizes, to enclose plants from a single plant to multiple rows of trees.

In one embodiment, the cubular utility barrier enclosure (C.U.B.E.) provides improvements over current enclosures used as shade and waterproof canopies, barriers, or airtight structures, dwellings, storage, shipping and recreational enclosures.

In one embodiment, the cubular utility barrier enclosure (C.U.B.E.) provides improvements over current enclosures used as shade and waterproof canopies for outdoor vendor booths.

In one embodiment, the cubular utility barrier enclosure (C.U.B.E.) provides improvements over current enclosures used as net tents and screen enclosures of various sizes, to accommodate a single person or multiple people.

In one embodiment, the cubular utility barrier enclosure (C.U.B.E.) provides improvements over current enclosures used as has humanitarian relief family tent shelters.

4. BRIEF DESCRIPTION OF THE DRAWINGS

The present invention is described herein with reference to the accompanying drawings, in which similar reference characters denote similar elements throughout the several views. It is to be understood that in some instances, various aspects of the invention may be shown exaggerated or enlarged to facilitate an understanding of the invention.

Appendix 1 sets forth illustrations of the present invention as FIGS. 1-22. In the Drawing:

FIG. 5 is a schematic illustration of four pole members connected together to form a continuous loop, in an assembled flexed condition, with the membrane boundary of FIG. 1 and FIG. 2 shown dotted;

FIG. 6 is a schematic illustration of one of the four separate pole members of FIG. 5 in a pole segments connected, non-flexed condition;

FIG. 7 is a perspective view, partly broken away, illustrating a lower angle member connecting portion of the pole segments of FIG. 3, FIG. 5 and FIG. 6;

FIG. 8 is a perspective view, partly broken away, illustrating an upper angle member connecting portion of the pole segments of FIG. 5 and FIG. 6;

FIG. 9 is a perspective view, partly broken away, illustrating a straight member connecting portion of the pole segments of FIG. 5 and FIG. 6;

FIG. 10 is a perspective view, partly broken away, similar to FIG. 9, illustrating the interconnecting and flexible nature of the "shock-cord".

FIG. 11 is a perspective view of an illustrative embodiment of the present invention showing invention using a two pole loops configuration with a closed floor and a closed door;

FIG. 12 is a perspective view of an illustrative embodiment of the present invention showing invention using a two pole loops configuration with a closed floor and an open door;

FIG. 13 is a schematic illustration of two pole members connected together to form two continuous pole loops, in an assembled flexed condition, with the membrane boundary of FIG. 11 and FIG. 12 shown dotted;

FIG. 14 is a schematic illustration of one of the two separate pole members of FIG. 13 in a pole segments connected, non-flexed condition;

FIG. 15 is a perspective view, partly broken away, illustrating three stages of optionally connecting the two end sections of one pole loop in clamps at the mid-section of the other pole loop where the two pole loops cross, of the pole segments of FIG. 13 and FIG. 14;

FIG. 15A is a perspective view, partly broken away, illustrating the two end sections of one pole loop lined-up to optionally connect in clamps at the mid-section of the other pole loop where the two pole loops cross, of the pole segments of FIG. 13 and FIG. 14;

FIG. 15B is a perspective view, partly broken away, illustrating the two end sections of one pole loop positioned in clamps to optionally connect to the mid-section of the other pole loop at the location where the two pole loops cross, of the pole segments of FIG. 13 and FIG. 14;

FIG. 15C is a perspective view, partly broken away, illustrating the two end sections of one pole loop positioned in clamps with a securing mechanism in place to optionally connect to the mid-section of the other pole loop at the location where the two pole loops cross, of the pole segments of FIG. 13 and FIG. 14;

FIG. 16 is a perspective view, partly broken away, illustrating two stages of connecting the two end sections of one pole loop together optionally using a telescoping pole section, of the pole segments of FIG. 13 and FIG. 14;

FIG. 16A is a perspective view, partly broken away, illustrating the two end sections of one pole loop lined-up to optionally connect together using a telescoping pole section, of the pole segments of FIG. 13 and FIG. 14;

FIG. 16B is a perspective view, partly broken away, illustrating the two end sections of one pole loop positioned end to end, to optionally connect together using a telescoping pole section, of the pole segments of FIG. 13 and FIG. 14;

Figure 17:
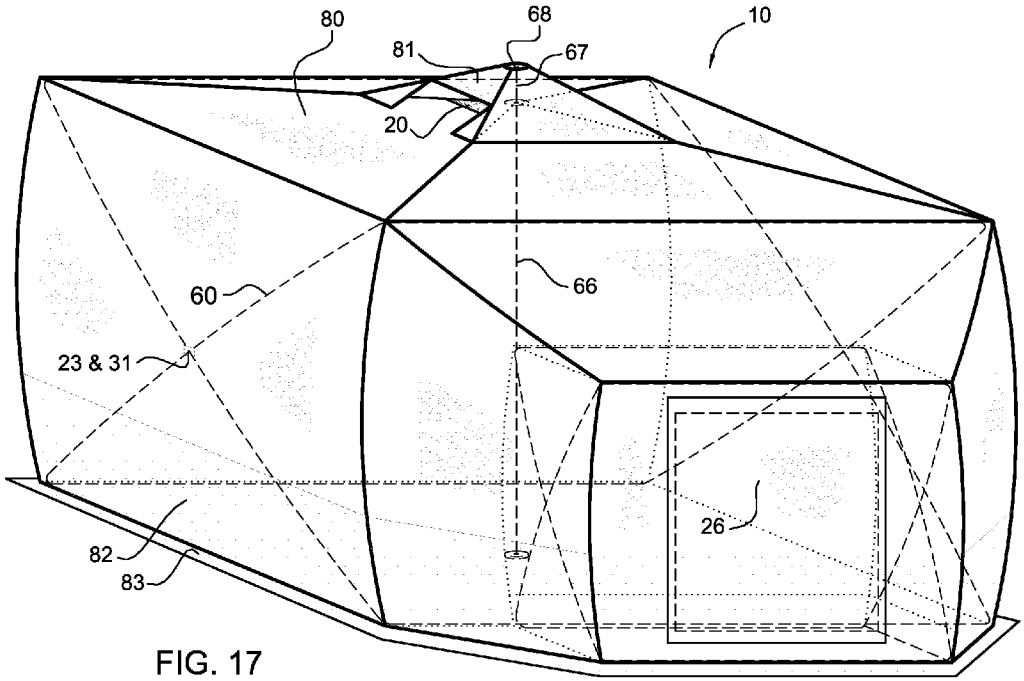
FIG. 17 is a perspective view of an illustrative embodiment of the present invention showing invention in a scaled-up configuration with two (C.U.B.E.) side by side, one larger than the other, each having two pole loops, and an optional straight pole with end caps, pushing-up at center of the membrane, covered together under an additional membrane shell to function as one.
Figure 18:
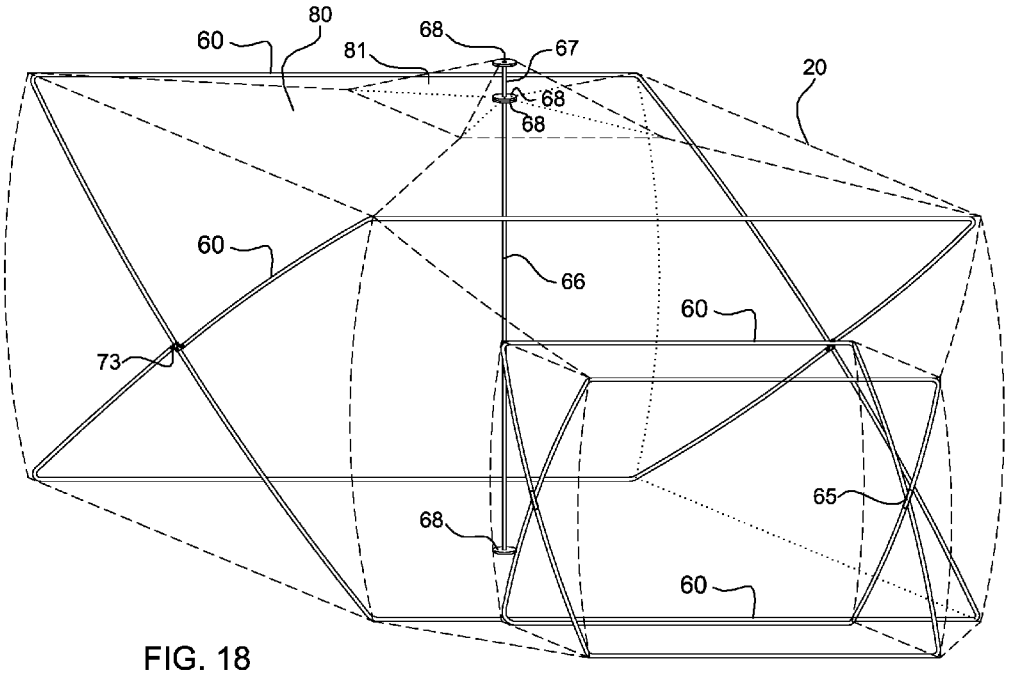
FIG. 18 is a schematic illustration of two pairs of pole members connected together to form four continuous loops, in an assembled flexed condition, and an optional straight pole with end caps, pushing-up at center of the membrane, with the membrane boundary of FIG. 17 shown dotted.
Figure 19:
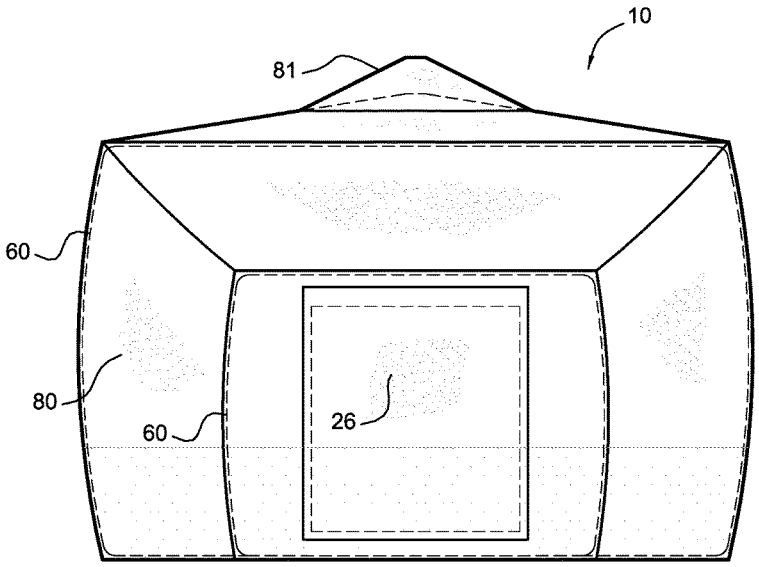
Figure 20:
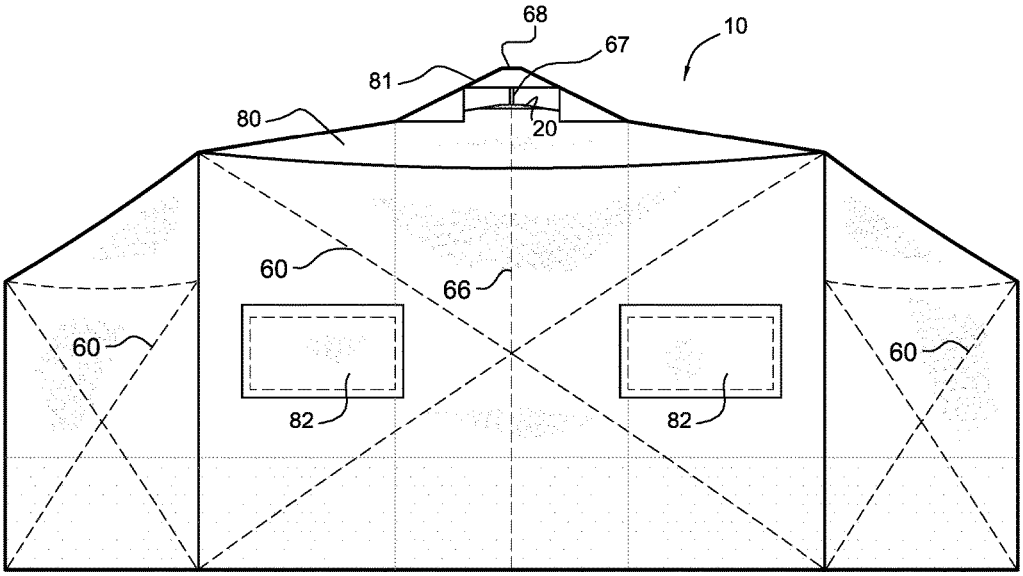
Figure 21:
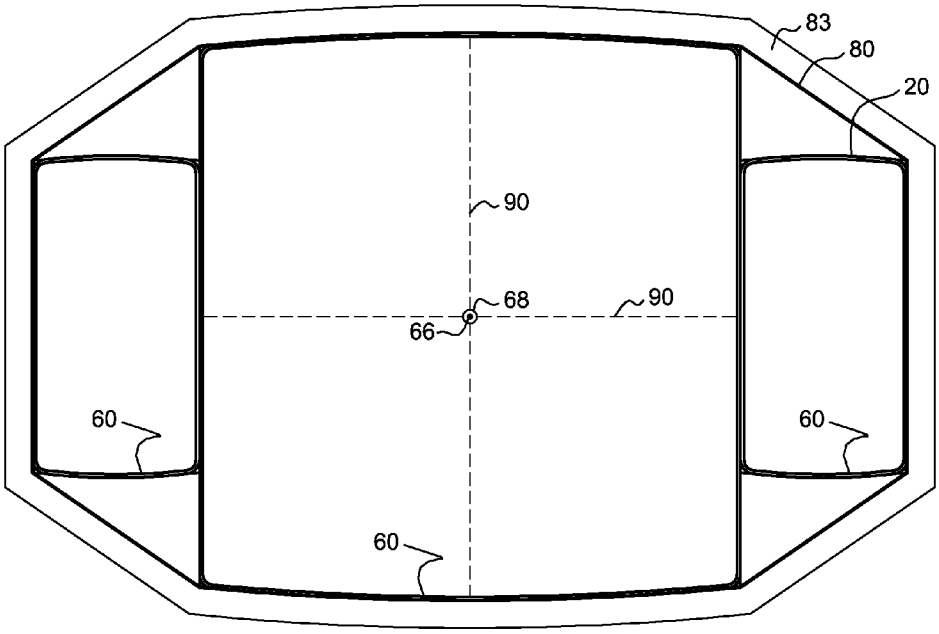
Figure 22:
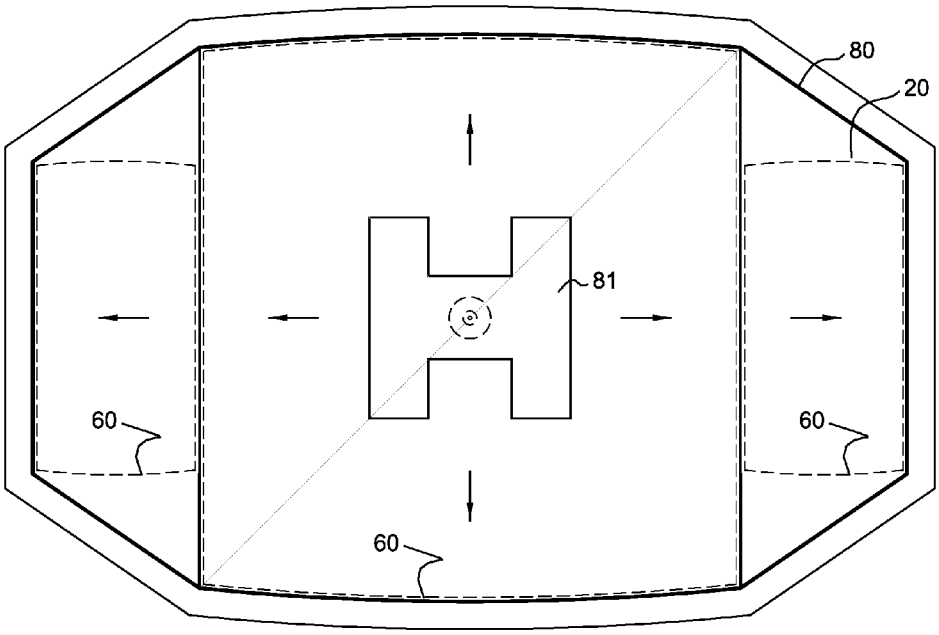

FIG. 19 is a front view of an illustrative embodiment of the present invention showing invention in a scaled-up configuration with two (C.U.B.E.) side by side, one larger than the other, each having two pole loops, and an optional straight pole with end caps, pushing-up at center of the membrane, covered together under an additional composite membrane shell to function as one, of FIG. 17 and FIG. 18;

FIG. 20 is a side view of an illustrative embodiment of the present invention showing invention in a scaled-up configuration with two (C.U.B.E.) side by side, one larger than the other, each having two pole loops, and an optional straight pole with end caps, pushing-up at center of the membrane, covered together under an additional composite membrane shell to function as one, of FIG. 17, FIG. 18 and FIG. 19;

FIG. 21 is a floor plan view of an illustrative embodiment of the present invention showing invention in a scaled-up configuration with two (C.U.B.E.) side by side, one larger than the other, each having two pole loops, and an optional straight pole with end caps, pushing-up at center of the membrane, covered together under an additional composite membrane shell to function as one, of FIG. 17, FIG. 18, FIG. 19 and FIG. 20; and FIG. 22 is a roof plan view of an illustrative embodiment of the present invention showing invention in a scaled-up configuration with two (C.U.B.E.) side by side, one larger than the other, each having two pole loops, and an optional straight pole with end caps, pushing-up at center of the membrane, covered together under an additional composite membrane shell to function as one, of FIG. 17, FIG. 18, FIG. 19, FIG. 20 and FIG. 21;

5. DETAILED DESCRIPTION OF THE INVENTION

A scalable, light-weight, portable, self-supporting and adjustable, multi-purpose, cubular utility barrier enclosure (C.U.B.E.) provides improvements over other utility enclosures by employing a membrane that defines a space and resiliently flexible segmented poles, that maintain a stable shape as the membrane is pushed out by the poles connected together in loops contained within the space, that are caused to bend in a flexed condition and are biased in place by the membrane when the poles are positioned in a freestanding manner, with adjustable section lengths that slip fit connect together to form various flexed loop configurations in proportion with the membrane to be biased in place.

Referring to Appendix 1, an exemplary embodiment of a utility 10 is illustrated. The utility 10 can comprise providing a multi-purpose, cubular utility barrier enclosure (C.U.B.E.).

Embodiments of the versatile utility can be any membrane or combination of membranes proportionally configured with any flexed pole loop configurations to be biased in place, defining space.

For clarity of disclosure, and not by way of limitation, the detailed description of the invention is set forth below.

Figure 1:
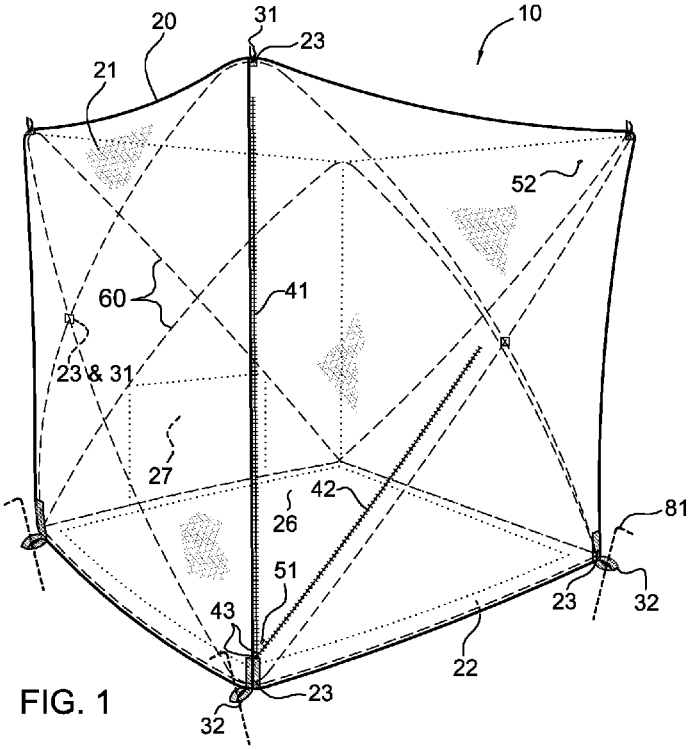
FIG. 1 is a perspective view of an illustrative embodiment of the present invention showing invention in a closed door configuration with an open floor and inside skirt.

FIG. 1 illustrates the cubular utility barrier enclosure (C.U.B.E.) invention 10 in a closed configuration with an open floor and inside skirt designed to accommodate a tree or persons with enough room to stand-up and walk around inside, being lightweight and easily transportable making it ideal for military applications, disaster relief, humanitarian shelters, insectary field cage applications, storage and shipping, as well as recreational use.

The cubular utility barrier enclosure (C.U.B.E.) 10 being a pliable mesh membrane covering 20, having four side walls and a ceiling 21, a floor skirt 22, and is a self-supporting structure in that it does not require suspension lines to hold its shape or to maintain stability.

More specifically, the side walls and ceiling 21 and the floor skirt 22, hold their shape as they are pushed-out by resiliently flexible, segmented poles 60 having straight sections 61, and angles 63 and 64 each, held in a flexed condition and biased in place by the proportions of the side walls, ceiling, floor skirt, and poles, as the poles 60 being connected together in loops, contained within the space, are caused to bend in a flexed condition and are biased in place by the membrane 20 when the poles are positioned in a freestanding manner, bowed-out as the poles cross diagonally, optionally being secured in place with membrane reinforcing patches 23 and securable straps 31 at the top inside corners and at midpoint of side walls where the poles intersect, thereby forming the shape that supports the free-standing, cubular utility barrier enclosure (C.U.B.E.) 10.

The segmented poles 60 having straight sections 61, with angles 63 and 64 each, are bowed-out, being held in a resiliently flexed loop shape position that causes a tensing of the poles with side walls and ceiling 21 and the floor skirt 22. Membrane reinforcing patches 23 and securable straps 31 attached on the exterior of the four top corners provide an alternative "back-up" method of suspension in absence of the flexible poles, and straps 32 attached on the exterior of the four lower corners to provide an optional means to secure to the ground or base. The side wall has a door opening that includes two reversible zippers 41, and 42 configured in a "V", each having zipper sliders 43 operable from either inside or outside the enclosure, and "loop" tabs 51 in the door flap point that allows the door flap 26 to be pulled back and secured to "hook" tabs 52 at the top of the inside side wall. A pliable membrane pouch 27 having a "hook and loop" fastener 53, is attached on the inside to provide storage for items and reverses to store the cubular utility barrier enclosure (C.U.B.E.) 10 with poles 60 and anchor stakes 81 for transport.

Figure 2:
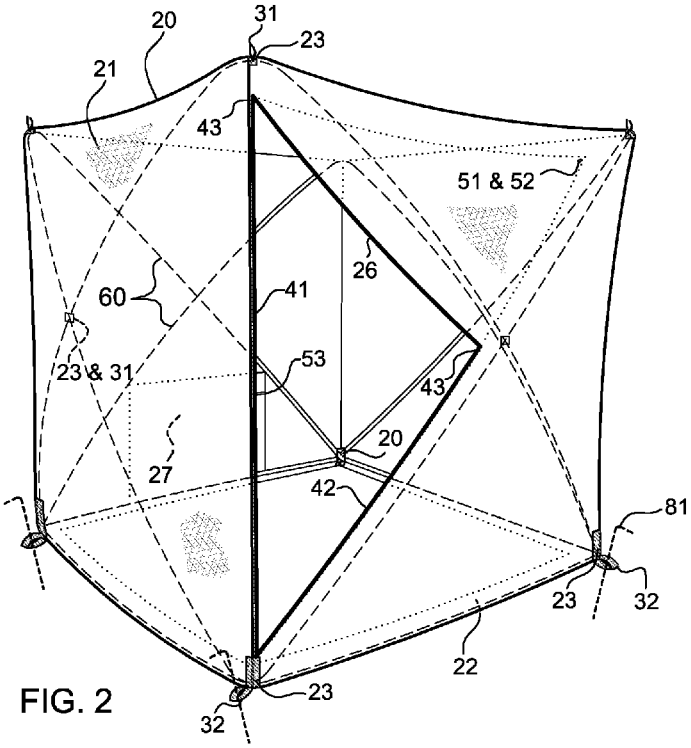
FIG. 2 is a perspective view of an illustrative embodiment of the present invention showing invention in an open door configuration with an open floor and inside skirt.

FIG. 2 illustrates the open configuration of the cubular utility barrier enclosure (C.U.B.E.) 10 showing its side wall 21 having the door flap 26 made operable with zippers 41 and 42 of membrane 20, pulled-back and secured open to the inside side wall with "hook and loop" tabs 51 and 52 providing full accessibility.

Figure 3:
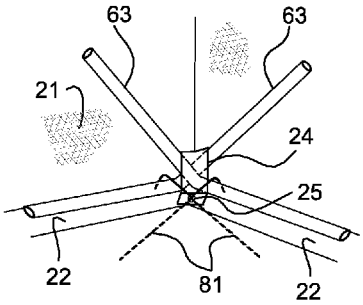
FIG. 3 is an enlarged view of a lower inside corner portion of the enclosure of FIG. 2 showing two crossing pole angle members, lower corner strap and an anchoring method.

FIG. 3 is an enlarged view of a lower inside corner portion of the enclosure of FIG. 2 showing two crossing pole angle members 63, lower inside corner of side wall 21 with floor skirt 22, securing strap 24 with hole 25, and anchor stakes 81. In the illustrated embodiment, the anchoring method in the lower inside corners causes the poles to flex even further, increasing the stability of the cubular utility barrier enclosure (C.U.B.E.) 10 without the need for guy wires.

Figure 4:
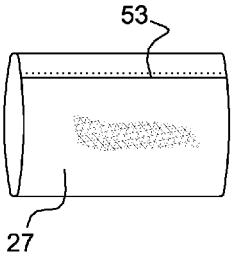
FIG. 4 is a schematic illustration of a membrane storage pouch with the enclosure, poles and stakes of FIG. 1, FIG. 2 and FIG. 3 inside.

FIG. 4 illustrates how the membrane pouch 27 with a "hook and loop" fastener 53 conveniently and securely packages the cubular utility barrier enclosure (C.U.B.E.) 10, with the poles 60 and stakes 81 for transport.

FIG. 5 illustrates a preferred construction of the cubular utility barrier enclosure (C.U.B.E.) 10, showing four segmented poles 60 connected together in a continuous loop, and in an assembled flexed condition, with the membrane boundary 20 shown dotted. The pole members are each formed by a plurality of respective straight segments 61, with angles 63 and 64 each, are bowed-out, being held in a resiliently flexed loop shape position that causes a tensing of the poles 60 with the membrane 20, each preferably made from a resiliently flexible round tubing of aluminum alloy, high strength carbon, fiberglass, PVC or other flexible pole material.

FIG. 6 is a schematic illustration of one of the four separate pole members of FIG. 5 in an assembled non-flexed condition, showing straight sections 61, and angles 63 and 64.

FIG. 7 illustrates how the tubular angle member 63 with inserts 62 and the elastic "shock-cord" running through 71 connect to adjacent pole segments 61, and form the lower corners of the cubular utility barrier enclosure (C.U.B.E.) 10.

FIG. 8 illustrates how the tubular angle member 64 with inserts 62 and the elastic "shock-cord" running through 71 connect to adjacent pole segment 61, and form the top corners of the cubular utility barrier enclosure (C.U.B.E.) 10.

FIG. 9 illustrates how the pole segments 61 are detachable and inter-fitted by a tubular insert portion 62 that extends from one end of respective segment and of a diameter to slip fit within an open end portion of an adjacent segment 61. The elastic "shock-cord" 71 running through the inside of the pole members interconnects adjacent segments, pulling them together to hold securely when assembled and maintaining their respective positions when disassembled.

FIG. 10 illustrates how the pole segments 61 with insert 62 are designed to be collapsible due to the interconnecting and flexible nature of the "shock-cord", for convenient storage and transport, yet to be quickly and easily assembled.

FIG. 11 illustrates the cubular utility barrier enclosure (C.U.B.E.) invention 10 in a two pole loops 60 configuration with a closed door 26 and closed floor with waterproof membrane 28, reinforcing patches 23 and securable straps 31 at the top inside corners and at midpoint of side walls where the poles intersect, and straps 32 at the lower exterior corners, designed to accommodate a person with enough room to stand-up and walk around inside membrane 20, being lightweight and easily transportable making it ideal for military applications, disaster relief, humanitarian shelters, insectary field cage applications, storage and shipping, as well as recreational use.

FIG. 12 illustrates the cubular utility barrier enclosure (C.U.B.E.) invention 10 in a two pole loops 60 configuration with a open door 26 and closed floor with waterproof membrane 28, reinforcing patches 23 and securable straps 31 at the top inside corners and at midpoint of side walls where the poles intersect, and straps 32 at the lower exterior corners, designed to accommodate a person with enough room to stand-up and walk around inside membrane 20.

FIG. 13 illustrates a preferred construction of the cubular utility barrier enclosure (C.U.B.E.) 10, showing two segmented poles 60 connected together with optional telescoping pole section 65, in two continuous loops, and in an assembled flexed condition, with the membrane boundary 20 shown dotted. The pole members are each formed by a plurality of respective straight segments 61, with angles 63, are bowed-out, being held in a resiliently flexed loop shape position that causes a tensing of the poles 60 with the membrane 20, each preferably made from a resiliently flexible round tubing of aluminum alloy, high strength carbon, fiberglass, PVC or other flexible pole material.

FIG. 14 is a schematic illustration of one of the two separate pole members of FIG. 13 in a segment connected, non-flexed condition, showing straight sections 61, angles 63, and optional telescoping pole section 65, end tips 72 and clamps 73.

FIG. 15 is a perspective view, partly broken away, illustrating three stages of optionally connecting the two end sections 61 with end tips 72 of one pole loop in clamps 73 with securing mechanism 74, at the mid-section of the other pole loop where the two pole loops cross.

FIG. 15A is a perspective view, partly broken away, illustrating three stages of optionally connecting the two end sections 61 with end tips 72 of one pole loop in clamps 73 with securing mechanism 74, at the mid-section of the other pole loop where the two pole loops cross, showing the two end sections 61 separated.

FIG. 15B is a perspective view, partly broken away, illustrating three stages of optionally connecting the two end sections 61 with end tips 72 of one pole loop in clamps 73 with securing mechanism 74, at the mid-section of the other pole loop where the two pole loops cross, showing the two end sections 61 with end tips 72 connected in clamps 73.

FIG. 15C is a perspective view, partly broken away, illustrating three stages of optionally connecting the two end sections 61 with end tips 72 of one pole loop in clamps 73 with securing mechanism 74, at the mid-section of the other pole loop where the two pole loops cross, showing the two end sections 61 with end tips 72 connected in clamps 73 and securing mechanism 74 fastened.

FIG. 16 is a perspective view, partly broken away, illustrating two stages of connecting the two end sections 61 of one pole loop together optionally using a telescoping pole section 65.

FIG. 16A is a perspective view, partly broken away, illustrating two stages of connecting the two end sections 61 of one pole loop together optionally using a telescoping pole section 65, showing the two end sections 61 separated.

FIG. 16B is a perspective view, partly broken away, illustrating two stages of connecting the two end sections 61 of one pole loop together optionally using a telescoping pole section 65, showing the two end sections 61 connected with telescoping poles section 65.

FIG. 17 is a perspective view of an illustrative embodiment of the present invention showing invention in a scaled-up configuration with two (C.U.B.E.) 10 side by side, one larger than the other, each having two pole 60 loops, with reinforcing patches 23 and straps 31 on membrane 20 where poles intersect, and optional straight poles 66 and 67 with end caps 68, pushing-up at center of the membrane 20, covered together under an additional membrane shell 80, creating a vent opening at the top 81, and functioning as one, having a mud flap 82 and mud flap skirt 83, and access through door panel 26.

FIG. 18 illustrates a preferred construction of the cubular utility barrier enclosure (C.U.B.E.) 10, in a scaled-up configuration with two (C.U.B.E.) side by side, one larger than the other, each having two pole 60 loops, the larger showing optionally connecting the two end sections end tips 72 of one pole loop in clamps 73 at the mid-section of the other pole loop where the two pole loops cross, into two combined pole 60 loops, and the smaller showing connecting the two end sections of each of the pole 60 loops connected together optionally using a telescoping pole section 65, and in an assembled flexed condition, with the membrane boundary 20 and optional straight poles 66 and 67 with end caps 68, pushing-up at center of the membrane 20, covered together under an additional membrane shell 80, creating a vent opening at the top 81.

FIG. 19 is a front view of an illustrative embodiment of the present invention showing invention in a scaled-up configuration with two (C.U.B.E.) 10 side by side, one larger than the other, each having two pole 60 loops, covered together under an additional membrane shell 80, creating a vent opening at the top 81, and functioning as one, and access through door panel 26.

FIG. 20 is a side view of an illustrative embodiment of the present invention showing invention in a scaled-up configuration with three (C.U.B.E.) 10 side by side, one larger than the other two, each having two pole 60 loops, and optional straight poles 66 and 67 with end caps 68, pushing-up at center of the membrane 20, covered together under an additional membrane shell 80, creating a vent opening at the top 81, and functioning as one, with optional window flaps 82.

FIG. 21 is a floor plan view of an illustrative embodiment of the present invention showing invention in a scaled-up configuration with three (C.U.B.E.) 10 side by side, one larger than the other two, each having two pole 60 loops, and optional straight pole 66 with end cap 68, pushing-up at center of the membrane 20, with optional horizontal straps 90 connected to pole 60 loops and optional straight center pole 66 for additional tension, covered together under an additional membrane shell 80, and functioning as one with a mud flap skirt 83.

FIG. 22 is a roof plan view of an illustrative embodiment of the present invention showing invention in a scaled-up configuration with three (C.U.B.E.) 10 side by side, one larger than the other two, each having two pole 60 loops, biased in placed with membrane 20, covered together under an additional membrane shell 80 with roof vent 81, and functioning as one.

As illustrated herein, the new cubular utility barrier enclosure (C.U.B.E.) 10 structure and the novel method of support provide features not heretofore available in the known art. Specifically, the stable shape created is due to the configuration of the pole loops positioned in a freestanding manner within the interior space defined by the proportions of the membrane as it is pushed out by the pole loops that are caused to bend in a flexed condition and are biased in place by the membrane.

The various membrane material, scalable poles with adjustable section lengths provide a variety of shapes and sizes with an anchoring method structural dynamic that alleviates the need for the "securing means" or sleeves for the resilient members and the flexible sheeting material as required in prior art, allowing for an increased versatility, stability, ease and speed of deployment and disassembly.

As such the cubular utility barrier enclosure (C.U.B.E.) 10, being light-weight, portable, scalable with adjustable freestanding pole loops, can be configured to enclose objects of various shapes and sizes, and connected together utilizing various membranes having diverse properties.

Notwithstanding all of these advantages over the known apparatus, the overall versatility, scalability and adaptability features provided are unprecedented in the art.

While the present invention has been described with reference to a particular embodiment thereof, it is to be understood, that the invention is intended to be defined and limited by the appended claims.

Additionally, while a preferred embodiment of the invention has been described using specific terms, such description is for illustrative purposes only, and it is to be understood that changes and variations may be made without departing from the spirit or scope of the following claims.

APPENDICES/APPENDIX

Additional details of the above described embodiments are set forth in the appendix or appendices referred to hereinabove in the section entitled "Reference to Appendix," which appendix or appendices are attached hereto and form part of the Detailed Description of this utility patent application.

Where applicable, it is further contemplated that numerical values, as well as other values that are recited herein are modified by the term "about," whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

The present invention is not to be limited in scope by the specific embodiments described herein. Indeed, various modifications of the invention in addition to those described herein will become apparent to those skilled in the art from the foregoing description. Such modifications are intended to fall within the scope of the invention.

While embodiments of the present disclosure have been particularly shown and described with reference to certain examples and features, it will be understood by one skilled in the art that various changes in detail may be effected therein without departing from the spirit and scope of the present disclosure as defined by claims that can be supported by the written description and drawings. Further, where exemplary embodiments are described with reference to a certain number of elements it will be understood that the exemplary embodiments can be practiced utilizing either less than or more than the certain number of elements.

All references cited herein are incorporated herein by reference in their entirety and for all purposes to the same extent as if each individual publication, patent or patent application was specifically and individually indicated to be incorporated by reference in its entirety for all purposes.

The citation of any publication is for its disclosure prior to the filing date and should not be construed as an admission that the present invention is not entitled to antedate such publication by virtue of prior invention.

What is claimed is:

1. A scalable, light-weight, portable, self-supporting and adjustable, multi-purpose, cubular utility barrier enclosure, the enclosure comprising, a membrane configured to define a space, resiliently flexible poles having straight sections and angled corners, connected together to form flexed pole loops, having the straight sections bowed and the angled corners contained within the space, said flexed pole loops having the opposite straight sections being connected cross each other to define sidewalls of the enclosure to maintain a stable shape as the membrane is pushed out by the flexed pole loops, the pole loops are caused to bow in a flexed condition and are biased in place by the membrane when the flexed pole loops are positioned in a freestanding manner, the pole loops are scalable with adjustable section lengths that slip fit connect together to form various flexed pole loop configurations, having the bowed straight sections and the angled corners, proportionally with the membrane to be biased in place, wherein the membrane includes a plurality of anchoring straps for anchoring the flexed pole loops at the angled corners to the ground or a base, to force the bowed straight sections along the ground or base to press into the ground or base, causing increased structural tension in the stable shape without the need for guy wires, and the cubular utility barrier enclosure deployed alongside with additional cubular utility barrier enclosures, having the flexed pole loops with the bowed straight sections and the angled corners, proportionally with the membrane to be biased in place, and the group of cubular utility barrier enclosures covered together under an additional membrane shell to function as one enclosure.

2. A cubular utility barrier enclosure in claim 1, wherein the membrane is, constituted by any ridged or pliable sheet material, constituted by pliable mesh that is substantially impermeable to insects, comprised of durable, high-tenacity synthetic fiber, resistant to puncture, prolong exposure to the sun, wind and weather elements, constituted by other properties that include solar shading, substantially waterproof, thermally insulated, fire resistant, chemically treated, and configured in various shapes and sizes.

3. A cubular utility barrier enclosure in claim 1, wherein the pole loops are, formed by a plurality of pole segments that are inter-fitted and detachable, being tubular with an insert and/or outsert element extending from an end portion thereof and designed to fit within an end portion of the adjacent pole segment, being interconnected by an elastic"shock-cord" running through the inside of each of the pole segments, and slip-fit adjustable in a telescoping manner to adjust the pole segment lengths, further comprising the flexed pole loops secured to the membrane with reinforced fasteners.

4. A cubular utility barrier enclosure in claim 1, whereas the additional membrane is pushed out further on the inside, using an additional straight pole, the enclosure is biased in place by the additional membrane when positioned vertically in a freestanding manner.

5. A cubular utility barrier enclosure in claim 1, further comprising additional membranes that are biased in place together by the flexed pole loops.

6. A cubular utility barrier enclosure in claim 1, further comprising additional membranes that are attached to the poles and secured tight horizontally or suspended vertically.

7. A cubular utility barrier enclosure in claim 1, further comprising the cubular utility barrier enclosure deployed inside a larger cubular utility barrier enclosure having flexed pole loops with bowed straight sections and angled corners, proportionally with a larger membrane to be biased in place.

8. A cubular utility barrier enclosure in claim 1, whereas the poles are each formed by a plurality of pole segments that are inter-fitted and detachable, being tubular with an insert and/or outsert element extending from an end portion thereof and designed to fit within an end portion of the adjacent pole segment being inter-fitted and adjustable in a telescoping manner to adjust the pole segment lengths.

9. A cubular utility barrier enclosure in claim 1, whereas the poles are each formed by a plurality of pole segments that are inter-fitted and detachable, being tubular with an insert and/or outsert element extending from an end portion thereof and designed to connect an end portion of the adjacent pole segment being inter-fitted with fixed pole segment lengths.

10. A cubular utility barrier enclosure in claim 1, whereas the pole loops are each formed by a plurality of pole segments that are inter-fitted and detachable, being tubular with end tip elements extending from the two opposite end sections of a pole loop thereof and designed to connect to clamps at the mid-section of the other pole loop where the two pole loops cross, combining the two pole loops into one flexed structural frame.

11. A cubular utility barrier enclosure in claim 1, whereas the pole loops are each formed by a plurality of pole segments that are inter-fitted and detachable, being tubular with end tip elements extending from the two opposite end sections of a pole loop thereof and designed to connect to clamps at the mid-section of the other pole loop where the two pole loops cross, with an additional telescoping pole section that enables connection of the two end sections of the same pole loop without using the clamps.

12. A cubular utility barrier enclosure in claim 1, whereas the membrane defines the space that has a closed floor with a waterproof membrane that extends partially up the side to create a waterproof tub.

* * * * *